US005743628A

United States Patent [19]

Greif et al.

[11] Patent Number: 5,743,628

[45] Date of Patent: Apr. 28, 1998

[54] FIELD-OF-OPERATION ILLUMINATING DEVICE ACCOMMODATING INCANDESCENT AND DISCHARGE LAMPS

[75] Inventors: Stefan Greif, Fulda; Jörg Eduard Hartge, Geinhausen; Till Schmeling, Wipperfuerth, all of Germany

[73] Assignee: Heraeus Med GmbH, Hanau, Germany

[21] Appl. No.: 600,485

[22] Filed: Feb. 12, 1996

[30] Foreign Application Priority Data

Feb. 21, 1995 [DE] Germany ..... 195 05 925.5

[51] Int. Cl.[6] ..... F21V 23/00

[52] U.S. Cl. ..... 362/228; 362/249; 362/241; 362/237; 362/804

[58] Field of Search ..... 362/249, 804, 362/228, 229, 235, 250, 404, 236, 237, 247, 241

[56] References Cited

U.S. PATENT DOCUMENTS

| | | | |
|---|---|---|---|
| 3,887,801 | 6/1975 | Ilzig . | |
| 4,064,425 | 12/1977 | Masson . | |
| 4,068,117 | 1/1978 | Masson . | |
| 4,196,460 | 4/1980 | Schreckendgust | 362/804 |
| 4,884,008 | 11/1989 | Bossler et al. | 362/804 |
| 5,174,648 | 12/1992 | Clary et al. | 362/249 |

FOREIGN PATENT DOCUMENTS

| | | | |
|---|---|---|---|
| 65 928/80 | 7/1982 | Australia . | |
| 75 23871 | 2/1977 | France . | |
| 23 34 912 | 2/1974 | Germany . | |
| 23 05 666 | 8/1974 | Germany . | |
| 24 30 583 | 1/1976 | Germany . | |
| 2519426 | 8/1976 | Germany | 362/804 |
| 21 66 957 | 12/1976 | Germany . | |
| 27 01 919 | 7/1977 | Germany . | |
| 26 19 519 | 11/1977 | Germany . | |
| 31 39 425 | 4/1983 | Germany . | |
| 36 11 138 | 10/1987 | Germany . | |
| 37 23 009 | 1/1989 | Germany . | |
| 38 07 585 | 9/1989 | Germany . | |
| 552 169 | 7/1974 | Switzerland . | |
| 819836 | 9/1959 | United Kingdom . | |

*Primary Examiner*—Thomas M. Sember
*Attorney, Agent, or Firm*—Frishauf, Holtz, Goodman, Langer & Chick, P.C.

[57] ABSTRACT

A field-of-operation illuminating device has at least one discharge lamp concentrically surrounded by several halide incandescent lamps at its bottom, which faces the field of operation. The discharge lamp is accommodated in a stationary reflector and illuminates the recesses of the field. The incandescent lamps are mounted in reflectors that can be adjusted so that their beams will overlap in the field. In the event of power outage or failure of the mains, power is supplied to the lamps from a battery-supported substitute source. The incandescent lamps, due to their thermal inertia, continue to burn almost uninterruptedly, whereas the discharge lamp remains off long enough to cool-down before being restarted. The advantages are less heat during normal operation and immediate availability of the incandescent lamps in an emergency.

17 Claims, 4 Drawing Sheets

FIELD-OF-OPERATION ILLUMINATING DEVICE ACCOMMODATING INCANDESCENT AND DISCHARGE LAMPS

BACKGROUND OF THE INVENTION

1. Field of the Invention

The present invention concerns a field-of-operation illuminating device especially intended for medical applications and accommodating in its housing at least one incandescent lamp and at least one discharge lamp. Both lamps simultaneously illuminate a prescribed field of operation through light-emitting areas in the bottom of the housing.

2. Background Information

An illuminating device for dental applications is known from German DE 31 39 425. Its annular housing accommodates an annular fluorescent discharge lamp with several incandescent lamps distributed in a circle around it. The radiation from each type of lamp is combined to produce daylight-like illumination of the field of operation, allowing the teeth being treated to be evaluated under constant conditions by the dentist, the technician, and the patient. Since all sources of light are accommodated in the same system, the illumination is relatively diffuse, and the strict collimation needed for actual operation is not entirely attainable.

British Patent 819 836 describes an illuminating device for dental applications. A housing accommodates an incandescent lamp at the center surrounded by a concentric annular fluorescent lamp. Although both types of lamps are present, their radiation is not combined, and each lamp illuminates only a specific area, the actual field of operation or its periphery.

Another field-of-operation illuminating device is known from German DE 38 07 585. Its source of light is a high-pressure gas-discharge lamp connected to a power-supply circuit. The power-supply circuit connects by way of a buffer to an adaptor that obtains power from the mains. The buffer connects by way of a sentry circuit to an emergency power supply that also obtains power from the mains. The emergency power supply is connected to by way of the sentry circuit in a power failure. The lamp is preferably a high-yield short-arc tin-halide lamp with a high color-rendition index and a long life.

One drawback to the illuminating device of German DE 38 07 585 is the comparatively complicated power-supply circuit with its many switches for transition between firing potential and operating potential. Again, the only source of light left when the discharge lamp fails is an emergency lamp.

German DE 36 11 138 discloses an illuminating device which includes a high-pressure discharge lamp and a switch for switching to a spare incandescent lamp in the form of a halide lamp. German DE 36 11 138 concerns strictly reserve operation, meaning that both lamps cannot be employed at the same time.

SUMMARY OF THE INVENTION

The object of the present invention is to furnish a field-of-operation illuminating device for medical applications that emits a continuous spectrum in the visible range at a color temperature of approximately 4000 to 5000K and at a uniform intensity. Color rendition is accurate and heat is low in the field of operation. The device operates reliably in the event of a power outage or when one of the lamps fails, providing satisfactory light within a few seconds in accordance with prevailing safety standards.

This object is attained in accordance with the present invention which concerns a field-of-operation illuminating device, especially intended for medical applications. The illuminating device includes a housing which accommodates at least one incandescent lamp and at least one discharge lamp. Both the at least one incandescent lamp and the at least one discharge lamp illuminate a prescribed field of operation through light-emitting areas in the bottom of the housing. Each of the at least one incandescent lamp and the at least one discharge lamp is provided with its own light-emitting area and optics for collimating and orienting the light, whereby the at least one incandescent lamp provides 40 to 60% of the total intensity of illumination and the at least one discharge lamp provides 60 to 40% of the total intensity of illumination.

The present invention serves to reduce shadows and obtains strict collimation on the part of each individual source of light. The present invention also serves to maintain at least approximately half the normal intensity in the field of operation in the event of power outage or lamp failure. A further advantage of the present invention is that the illuminating device emits 15 to 35% less heat in normal operation, than a device having only incandescent lamps.

In a preferred embodiment of the present invention, both the incandescent lamp and the discharge lamp are connected to a substitute source of electricity. The result is almost instantaneous switching, and the incandescent lamps will continue to operate, while the discharge lamp will be re-ignited by a power-supply circuit. The associated 50% decrease in intensity until the restoration of regular operation is acceptable at least briefly in practice. A concomitant advantage is that there is no need for complex hot re-ignition.

The discharge lamp is preferably a high-pressure mercury lamp dosed with iodine. A more or less continuous spectrum in the 300 to 800 mm range has been demonstrated particularly advantageous. One preferred embodiment of the discharge lamp contains an iodide of sodium, thallium, dysprosium, thulium or holmium.

BRIEF DESCRIPTION OF THE DRAWINGS

For the purposes of illustrating the invention there is shown in the drawings forms which are presently preferred. It is to be understood, however, that the present invention is not limited to the precise arrangements and instrumentalities depicted in the drawings.

DETAILED DESCRIPTION OF THE INVENTION

Figure 1A:
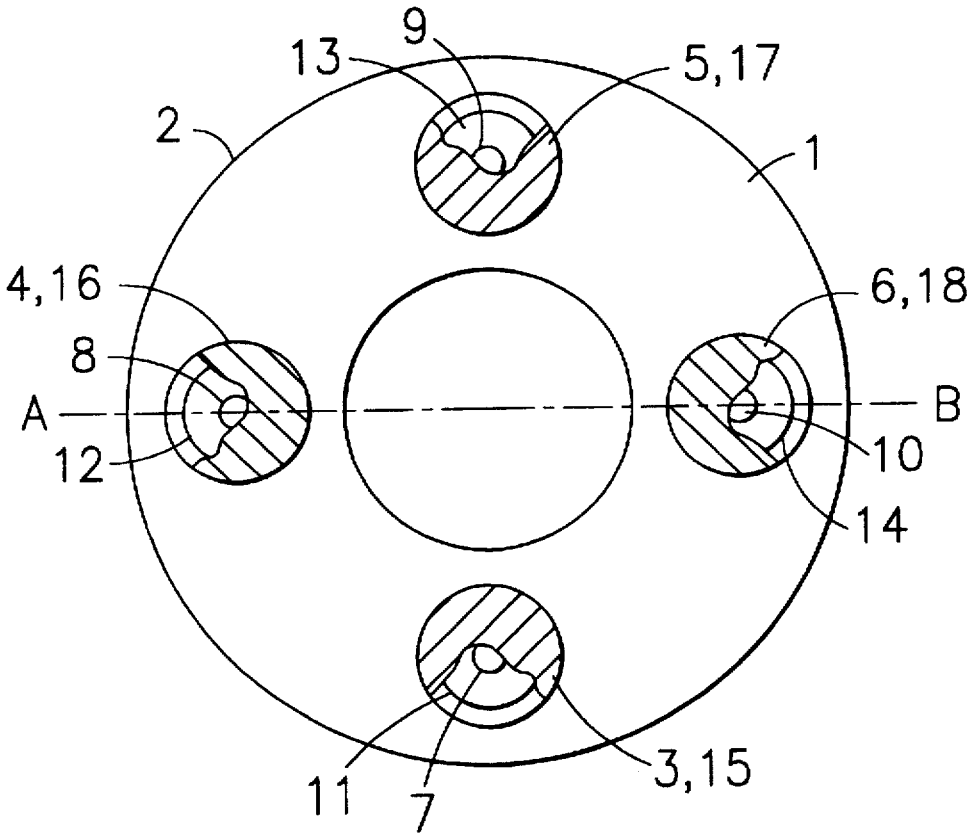
FIG. 1*a* a schematic, partly sectional, view of a field-of-operation illuminating device with a housing which accommodates three halide incandescent lamps and a discharge lamp, each with its own collimating system.

In FIG. 1*a*, the bottom 2, which faces the field of operation of the illuminating device 1 accommodates four light-emitting areas 3, 4, 5 and 6 distributed from each other at angles of 90°. Associated with the first three light-emitting areas, areas 3, 4 and 5, are three conventional halide incandescent lamps 7, 8 and 9. Each lamp 7, 8 and 9 is mounted in a reflector 11, 12 and 13, respectively. Each reflector reflects infrared light, which is removed by filters over light-emitting areas 3, 4 and 5. Associated with light-emitting area 6 is a reflector 14. Reflector 14 accommodates a halide-metal high-pressure discharge lamp 10.

Since the electrodes in lamp 10 are only 5 to 9 mm apart, it acts as a point source. To allow generation of visible light, discharge lamp 10 is filled with mercury and one or more iodides to a cold-filling pressure of 200 to 300 mbars. Iodides of sodium, thallium, dysprosium, thulium, or holmium are particularly advantageous. Since little infrared radiation is to be expected from such a lamp, light-emitting area 6 is provided with a weak filter or ordinary glass transmitting light in the range of approximately 380 to 780 nm. The lamps 7, 8, 9 and 10 associated with light-emitting areas 3, 4, 5 and 6 can have focusing or pivoting reflectors 11, 12, 13 and 14, allowing the beams to overlap in the unillustrated field of operation and dissolve any shadows.

Figure 1B:
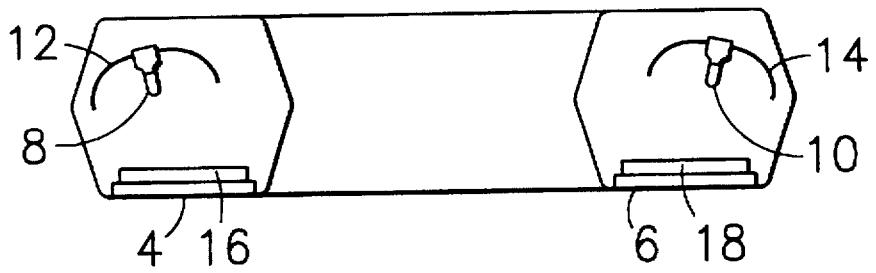
FIG. 1*b* is a sectional view taken along the line A-B in FIG. 1*a*.

The open section in FIG. 1*b* illustrates a light-emitting area 4 associated with a halide incandescent lamp 8 diametrically opposite a light-emitting area 6 associated with a discharge lamp 10. Area 4 is covered with a powerful infrared-absorbing filter 16 and light-emitting area 6 with a weak infrared-absorbing filter 18. It is on the other hand also possible, depending on the type of lamp 10, to eliminate its filter entirely. The reflectors can be installed and adjusted as disclosed in German Patent 37 23 009.

Figure 2A:
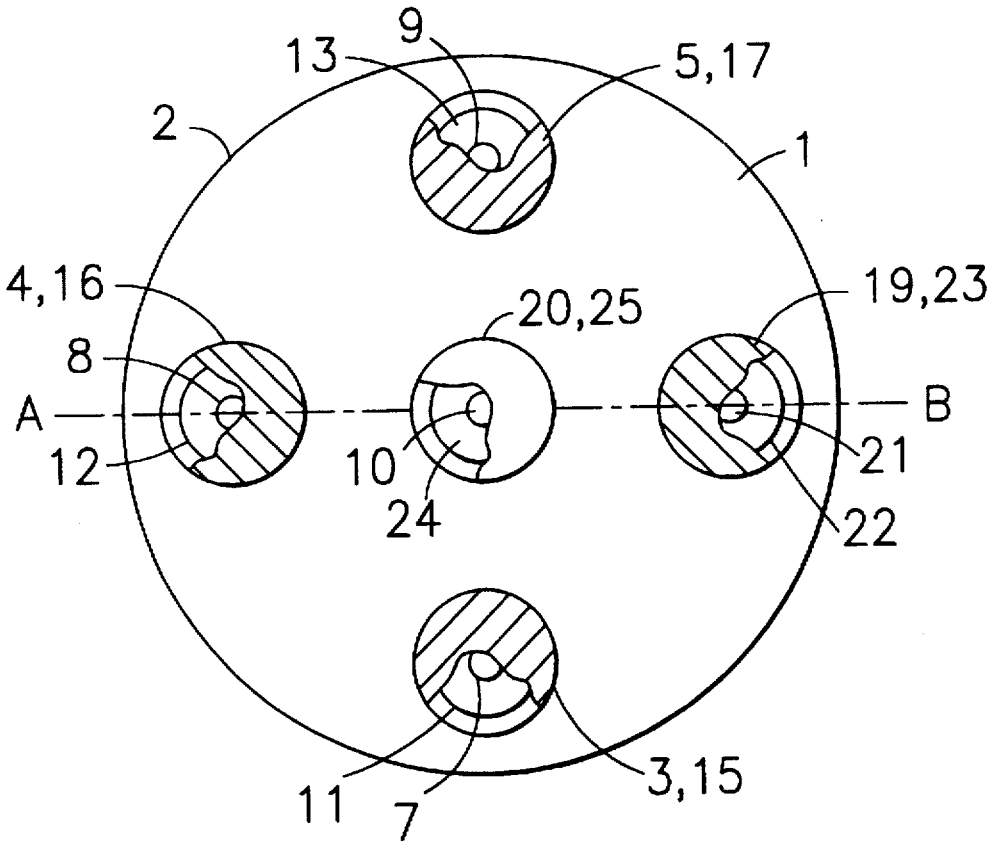
FIG. 2*a* a schematic, partly sectional, view of a field-of-operation illuminating device with four halide emitters distributed at angles of 90° around a discharge emitter at the center.

The bottom 2, which faces the field of operation, of the illuminating device 1 illustrated in FIG. 2*a* is provided with five light-emitting areas, four of them, areas 3, 4, 5 and 19, distributed around the periphery at angles of 90° from each other, and the fifth, light-emitting area 20, at the center. Light-emitting areas 3, 4, 5 and 19 are provided with halide incandescent lamps 7, 8, 9 and 21, each in its own reflector 11, 12, 13 and 22. Each light-emitting area is covered with an infrared-absorbing filter 15, 16, 17 and 23. Associated with light-emitting area 20 is a reflector 24 that accommodates a source of light in the form of a halide-metal vapor high-pressure discharge lamp 10. Since the electrodes in lamp 10 are as described above, only 5 to 9 mm apart, it can be considered a point source. To allow the generation of visible light, the lamp is filled with mercury and an iodide as specified with reference to FIG. 1*a*. Central light-emitting area 20 is also provided with a weak infrared-absorbing filter 25. Since area 20 is responsible for almost half the total intensity of the device, it is particularly effective in illuminating the depths of incisions and is accordingly rigidly mounted, without means of adjustment.

The halide incandescent lamps 7, 8, 9 and 21 associated with the four peripheral light-emitting areas; areas 3, 4, 5 and 19, together account for approximately 50% of the total intensity. These lamps will continue to operate uninterruptedly in the event of a power outage, whereas discharge lamp 10 will first cool and then be re-ignited.

Figure 2B:
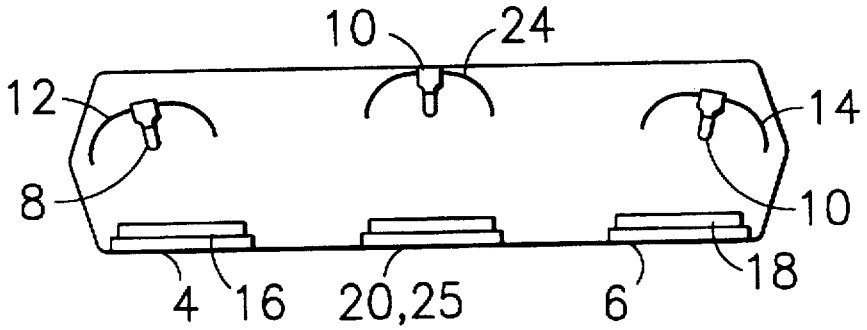
FIG. 2*b* is a sectional view taken along the line A-B in FIG. 2*a*.

The light-emitting areas 4 and 19 illustrated in FIG. 2*b* are provided with halide incandescent lamps 8 and 21 mounted in reflectors 12 and 22 and are diametrically opposite each other. At the center is light-emitting area 20, which is provided with a discharge lamp 10 mounted in a reflector 24. Area 20 is provided with a filter 25 similar to the weak infrared-absorbing filter 18 illustrated in FIGS. 1*a* and 1*b*.

Figure 3A:
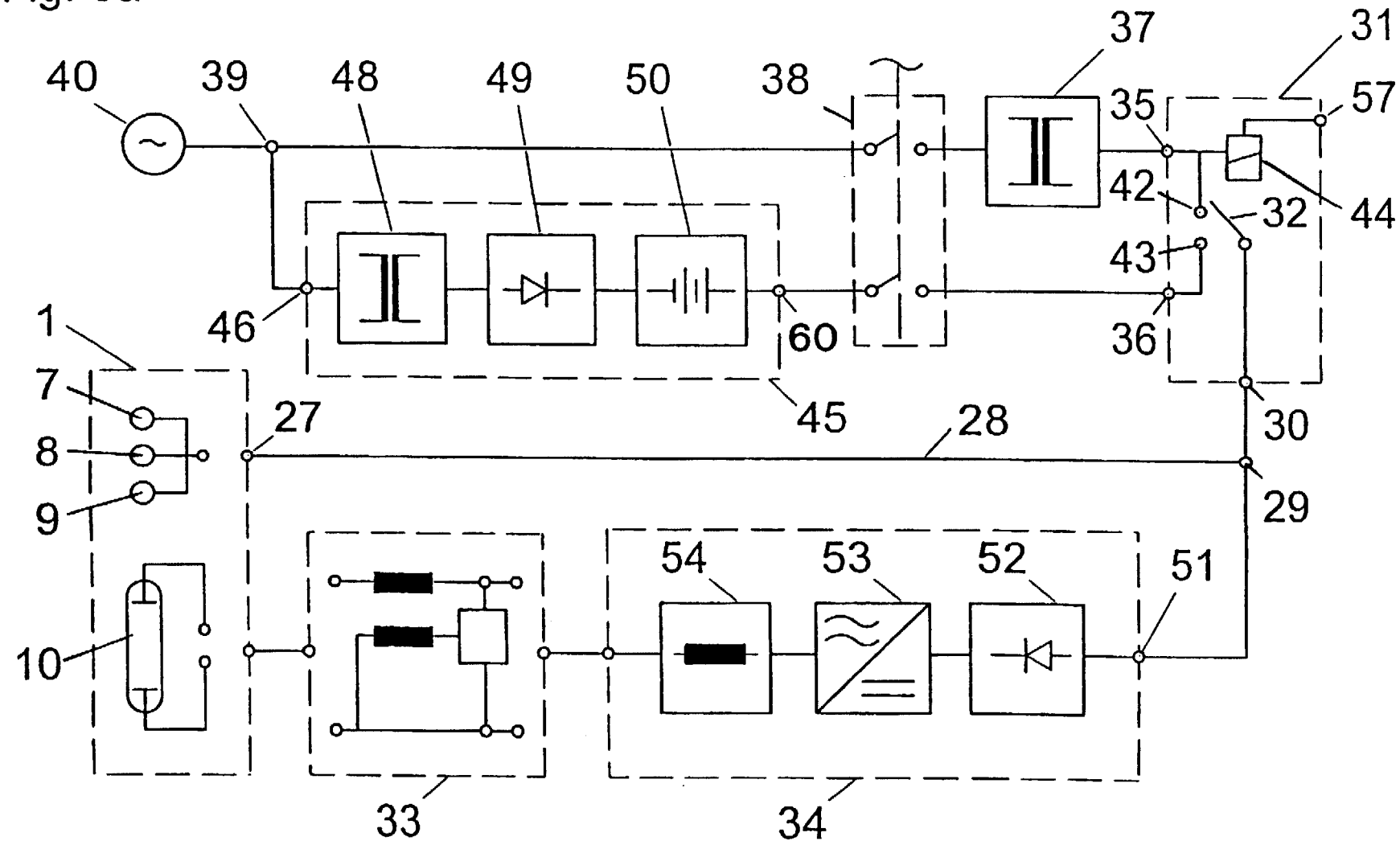
FIG. 3*a* is a block diagram of a circuit for supplying power to the field-of-operation illuminating device.

FIG. 3*a* is a block diagram illustrating a power supply circuit. The individual components set forth in FIG. 3*a* would be known to those of ordinary skill in the art.

The housing of the field-of-operation illuminating device 1 accommodates three incandescent lamps 7, 8 and 9 connected to the output terminal 30 of a switch 31 by way of a contact 27, a line 28 and a junction 29. The housing also accommodates a discharge lamp 10. Lamp 10 is connected to output terminal 30 by way of a starter 33, a ballast 34, and junction 29. Switch 31 has two input terminals 35 and 36. Input terminal 35 is connected secondarily to the stationary mains 40 by way of a transformer 37, operating switch 38 and a junction 39.

The moving contact 32 of switch 31 can be shifted between two stationary contacts 42 and 43. Moving contact 32 is controlled by an exciter coil 44. Contact 42 is connected to the first input terminal 35 and contact 43 to the second input terminal 36 of switch 31. Coil 44 is either connected to the secondary end of transformer 37 by way of a control input terminal 57 or is subjected to a special voltage of its own. Transformer 37 is actuated by outside power. In the event of a power failure, moving contact 32 is disconnected from stationary contact 42 and connected to stationary contact 43, connecting the second input terminal 36 of switch 31 to the output terminal 47 of emergency power supply 45 by way of operating switch 38. Emergency power supply 45 supplies power for operating the field-of-operation illuminating device in the event of a power outage. The input terminal 46 of emergency power supply 45 is connected to the junction 39 with mains 40. The primary end of a transformer 48 is also connected to input terminal 46. The secondary end of transformer 48 is connected to a battery charger 49. Battery charger 49 charges a battery or accumulator 50 that acts a source of power in an emergency.

A rectifier 52 is connected to the input terminal 51 of ballast 34. Rectifier 52 is also connected to an inverter 53. An inductance coil 54 is connected to the output terminal of the inverter 53. The output terminal of ballast 34 is connected to starter 33.

The primary ends of transformers 37 and 48 are designed for a mains potential of 110 to 240 V at 50 Hz, and their secondary ends for one of 24 to 28 V. The first input terminal, terminal 35, of switch 31 is accordingly provided with alternating current at approximately 24 V in normal operation. Its other input terminal, terminal 36, which is connected to the output terminal 60 of emergency power supply 45, is provided with direct current at approximately 24 V in the event of a power outage.

In normal operation, emergency power supply 45 is constantly provided with power from the mains, and battery or accumulator 50 is constantly being charged by way of transformer 48, the primary end of which is connected to the mains, and of charger 49. When operating switch 38 is actuated, illuminating device 1 is powered by way of transformer 37, switch 31, and junction 29, through line 28 to incandescent lamps 7, 8, and 9, and through ballast 34 to discharge lamp 10. When exciter coil 44 is activated, it will connect moving contact 32 to stationary contact 42. In the event of a power outage or other problem, the coil will not be activated, and moving contact 32 will be connected to stationary contact 43, coupling the device to emergency power supply 45. In this event, battery or accumulator 50 will provide power to junction 29. Incandescent lamps 7, 8, and 9 will, due to their thermal inertia, will continue to burn almost uninterruptedly throughout the switching procedure. Discharge lamp 10 will cool-off for approximately two to four minutes and be turned on again by starter 33, subsequent to which it will be provided with power again by ballast 34.

It is also possible to design switch 31 such that exciter coil 44 is actuated by a threshold circuit through control input terminal 57. When in this event the voltage does not attain a certain threshold, the device is switched to emergency operation in order to prevent fluctuations in intensity due to instabilities in the mains. The system can be restored to normal mains operation once the threshold has been maintained for a prescribed period.

Figure 3B:
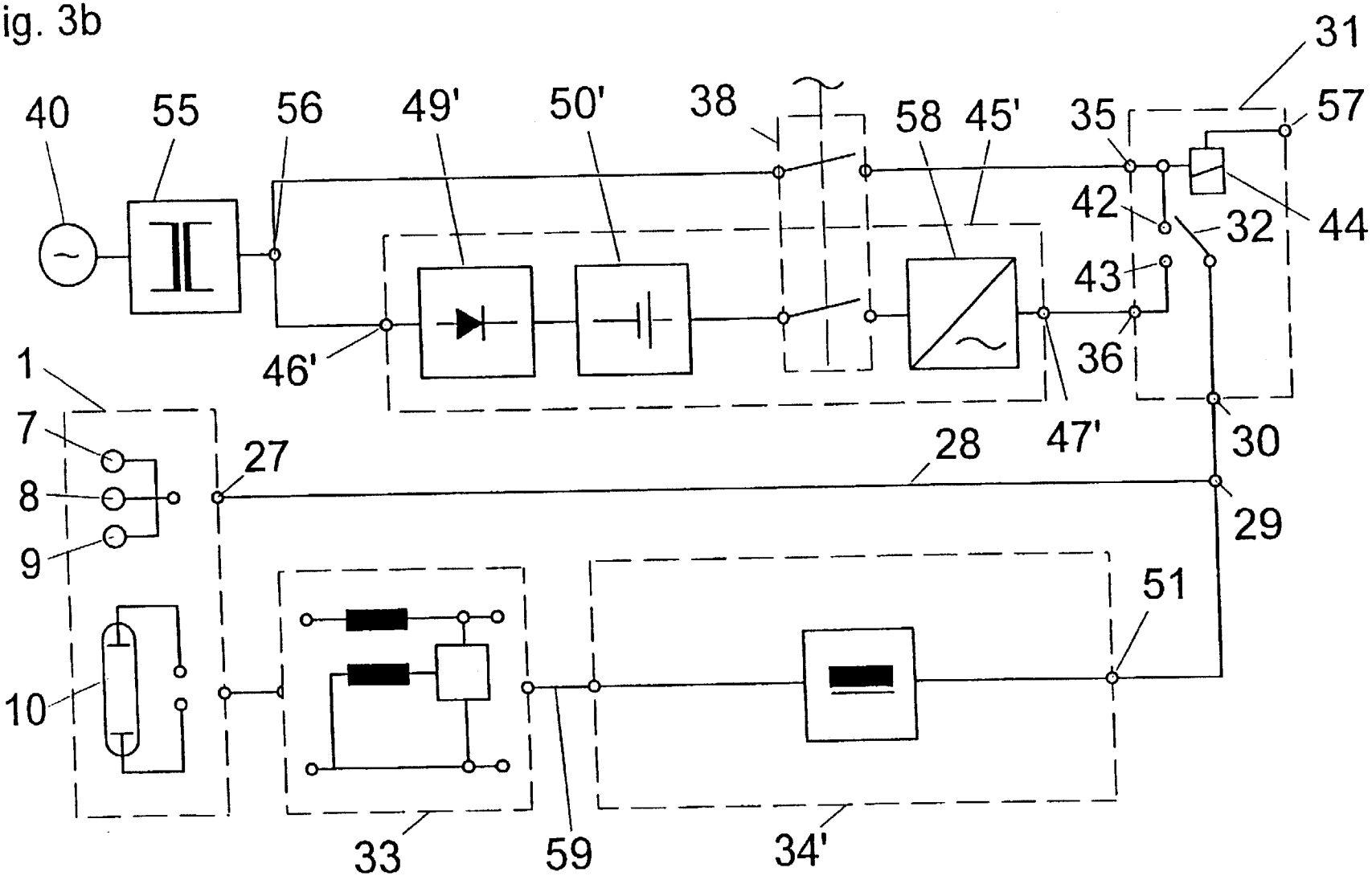
FIG. 3*b* is a block diagram of another circuit for supplying power to the field-of-operation illuminating device.

The halide incandescent lamps 7, 8 and 9 in the illuminating device 1 illustrated in FIG. 3*b* are, like those in FIG. 3*a*, connected to a switch 31 by way of contact 27 and line 28. Switch 31 is operated by mains power or by a sentry circuit. In normal operation, switch 31 is directly connected to the secondary end of a transformer 55. Transformer 55 itself is connected to mains 40 that supply alternating current. The housing of the device also contains a discharge lamp 10. Lamp 10 is connected to a starter 33 and to a ballast 34'. Ballast 34' is outside the housing and connected by way of switch 31 and operating switch 38 to the secondary end of transformer 55.

Transformer 55 is connected by way of junction 56 and operating switch 38 to the first input terminal, terminal 35, of a switch 31. Switch 31 is actuated by a sentry circuit in accordance with the mains situation. Switch 31 has a control input terminal 57. The output terminal 30 of switch 31 is connected by way of junction 29 to the ballast 34' of discharge lamp 10. Ballast 34' is connected to the discharge lamp 10 inside illuminating device 1 by way of starter 33 and line 59.

The other input terminal, terminal 36, of switch 31 is connected to the output terminal 47' of a substitute power supply 45'. Power supply 45' includes an accumulator or rechargeable battery 50'. Battery 50' is connected to a rectifier 58. The output terminal of rectifier 58 is also the output terminal 47' of substitute power supply 45'. Accumulator or rechargeable battery 50' is charged by a battery charger in the form of a rectifier 49'. Rectifier 49' is connected to the input terminal 46' of substitute power supply 45'. Input terminal 46 is directly connected to the junction 56 at the secondary end of transformer 55. Switch 31 is thrown by an exciter coil 44 acting on a moving contact 32, connecting input terminal 35 to output terminal 30 in the presence of mains power, whereby both incandescent lamps 7, 8 and 9 and ballast 34' are supplied directly from the junction 56 at the secondary end of transformer 55. Since input terminal 36 is connected to output terminal 30 in the event of a power failure, incandescent lamps 7, 8, and 9 and ballast 34' are connected to accumulator or rechargeable battery 50' by way of the output terminal 47' of substitute power supply 45' and operating switch 38. Discharge lamp 10 is also, as specified with reference to FIG. 3*a*, provided with a starter 33 accommodated in the housing of the device.

In normal operation, with power supplied by the mains, transformer 55, ballast 34', and starter 33 are powered by mains power, and accumulator or rechargeable battery 50' is simultaneously charged by rectifier 49'. In the event of power outage or decrease below the prescribed threshold, the moving contact 32 in switch 31 will be connected to the output terminal 47' of substitute power supply 45' byway of input terminal 36. Substitute power supply 45' will begin to supply direct current to illuminating device 1. The switching procedure, however, will be almost imperceptible due to the thermal inertia of the halide incandescent lamps, and at least 50% of the normal intensity will be immediately available. The discharge lamp on the other hand will need to briefly turn-off and cool before it can be started again. During this period, however, the field of operation will be illuminated by the aforesaid at least 50% of the normal intensity. Once the discharge lamp has had time to cool-off, it will turn on again and the device will return to normal operation.

When one of incandescent lamps 7, 8 and 9 burns out, the field will be darkened only slightly, whereas failure of discharge lamp 10 can result in a darkening of 40 to 50%. There will in any event still be enough light as a rule to continue the operation without any problem, because the decrease in light will, due to the logarithmic sensitivity of the human eye, be perceived as only slight.

It will be appreciated that the instant specification is set forth by way of illustration and not limitation, and that various modifications and changes may be made without departing from the spirit and scope of the present invention.

We claim:

1. A field-of-operation illuminating device comprising:

(a) a housing having a bottom with a plurality of light-emitting areas, (b) at least one incandescent lamp disposed in said housing, said at least one incandescent lamp having a light-emitting area associated therewith and optics for collimating and orienting light, and (c) at least one discharge lamp disposed in said housing, said at least one discharge lamp having a light-emitting area associated therewith and optics for collimating and orienting light, both of said at least one incandescent lamp and said at least one discharge lamp simultaneously illuminate a prescribed field of operation through said light-emitting areas in said bottom of said housing to provide a total intensity of illumination, wherein said at least one incandescent lamp provides 40 to 60% of the total intensity of illumination and said at least one discharge lamp provides 60 to 40% of the total intensity of illumination.

2. The field-of-operation illuminating device as in claim 1, wherein said at least one discharge lamp is a high-pressure mercury-vapor lamp, and said at least one incandescent lamp is a halide lamp.

3. The field-of-operation illuminating device as in claim 2, wherein said high-pressure, mercury-vapor lamp has a cold filling pressure of 200 to 300 mbars, and wherein at least one iodide is added to the filling to obtain a range of visible spectrum.

4. The field-of-operation illuminating device as in claim 3, wherein said at least one iodide is selected from the group consisting of sodium iodide, thallium iodide, dysprosium iodide, thulium iodide and holmium iodide.

5. The field-of-operating illuminating device as in claim 3, wherein said at least one discharge lamp has electrodes which are 5 to 9 mm apart.

6. The field-of-operation illuminating device as in claim 1 which provides a light of an emitted spectrum of 380 to 780 nm.

7. The field-of-operation illuminating device as in claim 1, wherein each of said at least one incandescent lamp and each of said at least one discharge lamp are mounted in a reflector, wherein at least some of the reflectors are adjustable such that individual light beams therefrom overlap and increase the intensity of the light for illuminating a field of operation.

8. The field-of-operation illuminating device as in claim 7, wherein said housing has a periphery at the bottom thereof, and said at least one discharge lamp is accommodated in a stationary reflector for deep illumination and said at least one discharge lamp is positioned between or surrounded by at least two halide incandescent lamps each distributed in its own reflector along the periphery of the bottom of the housing.

9. The field-of-operating illuminating device as in claim 8, wherein said at least one discharge lamp is a high-pressure mercury-vapor lamp with a cold filling pressure of 200 to 300 mbars and contains at least one iodide selected from the group consisting of sodium iodide, thallium iodide, dysprosium iodide, thulium iodide and holmium iodide, and said at least one incandescent lamp is a halide lamp.

10. The field-of-operation illuminating device as in claim 7, wherein said at least one discharge lamp is a single discharge lamp which is disposed substantially in a central portion at the bottom of the housing and said discharge lamp is surrounded by at least three halide incandescent lamps arranged in a circle around said discharge lamp.

11. The field-of-operating illuminating device as in claim 10, wherein said discharge lamp is a high-pressure mercury-vapor lamp with a cold filling pressure of 200 to 300 mbars and contains at least one iodide selected from the group consisting of sodium iodide, thallium iodide, dysprosium iodide, thulium iodide and holmium iodide, and each of said incandescent lamps is a halide lamp.

12. The field-of-operating illuminating device as in claim 7, wherein said at least one discharge lamp is a high-pressure mercury-vapor lamp with a cold filling pressure of 200 to 300 mbars and contains at least one iodide selected from the group consisting of sodium iodide, thallium iodide, dysprosium iodide, thulium iodide and holmium iodide, and said at least one incandescent lamp is a halide lamp.

13. The field-of-operation illuminating device as in claim 1, wherein said at least one incandescent lamp comprises four incandescent lamps which are electrically connected directly with the discharge lamp by way of a ballast to a switch that is switched back and forth by an exciter current delivered from a mains power position and an output terminal of a substitute power supply.

14. The field-of-operation illuminating device as in claim 13, wherein said substitute power supply includes a rectifier that charges a downstream accumulator, whereby an inverter disposed downstream of the accumulator supplies power to said ballast.

15. The field-of-operating illuminating device as in claim 13, wherein said at least one discharge lamp is a high-pressure mercury-vapor lamp with a cold filling pressure of 200 to 300 mbars and contains at least one iodide selected from the group consisting of sodium iodide, thallium iodide, dysprosium iodide, thulium iodide and holmium iodide, and said at least one incandescent lamp is a halide lamp.

16. The field-of-operating illuminating device as in claim 15, wherein each of said at least one incandescent lamp and each of said at least one discharge lamp are mounted in a reflector, wherein at least some of the reflectors are adjustable such that their individual light beams therefrom overlap and increase the intensity of the light for illuminating a field of operation.

17. The field-of-operating illuminating device as in claim 16, wherein said substitute power supply includes a rectifier that charges a downstream, accumulator, whereby an inverter disposed downstream of the accumulator supplies power to said ballast.

* * * * *